United States Patent [19]

Rao

[11] 3,931,852

[45] Jan. 13, 1976

[54] GAS TURBINE GENERATOR SEAL SYSTEM

[75] Inventor: V. Durga Nageswar Rao, Woodhaven, Mich.

[73] Assignee: Ford Motor Company, Dearborn, Mich.

[22] Filed: Nov. 12, 1973

[21] Appl. No.: 415,057

[52] U.S. Cl. ..... 165/9; 277/16; 277/81 R; 277/173

[51] Int. Cl. ..... F28d 19/00

[58] Field of Search ..... 165/9; 277/16, 81 R, 227, 277/173

[56] References Cited

UNITED STATES PATENTS

| | | | |
|---|---|---|---|
| 2,607,565 | 8/1952 | Jensen | 165/9 |
| 3,601,414 | 8/1971 | Rao | 165/9 X |
| 3,633,926 | 1/1972 | Hryniszab et al. | 165/9 X |
| 3,667,220 | 6/1972 | Dekeyser | 165/8 X |
| 3,743,008 | 7/1973 | Zeeb et al. | 165/9 |

*Primary Examiner*—Albert W. Davis, Jr.
*Attorney, Agent, or Firm*—Donald J. Harrington; Keith L. Zerschling

[57] ABSTRACT

A seal system for a rotary regenerator with a circular ceramic regenerator core, the seal system including a peripheral portion sealingly engaged with the margin of the core and a cross arm portion extending generally diametrically across the surface of the core, the peripheral seal portions on the cross arm portion being located in seal recesses formed in the gas turbine housing during the casting of the housing thereby forming a portion of the housing assembly, the seal portions being made in segments whereby provision is made for reducing or eliminating seal breakage and maintenance cost.

6 Claims, 17 Drawing Figures

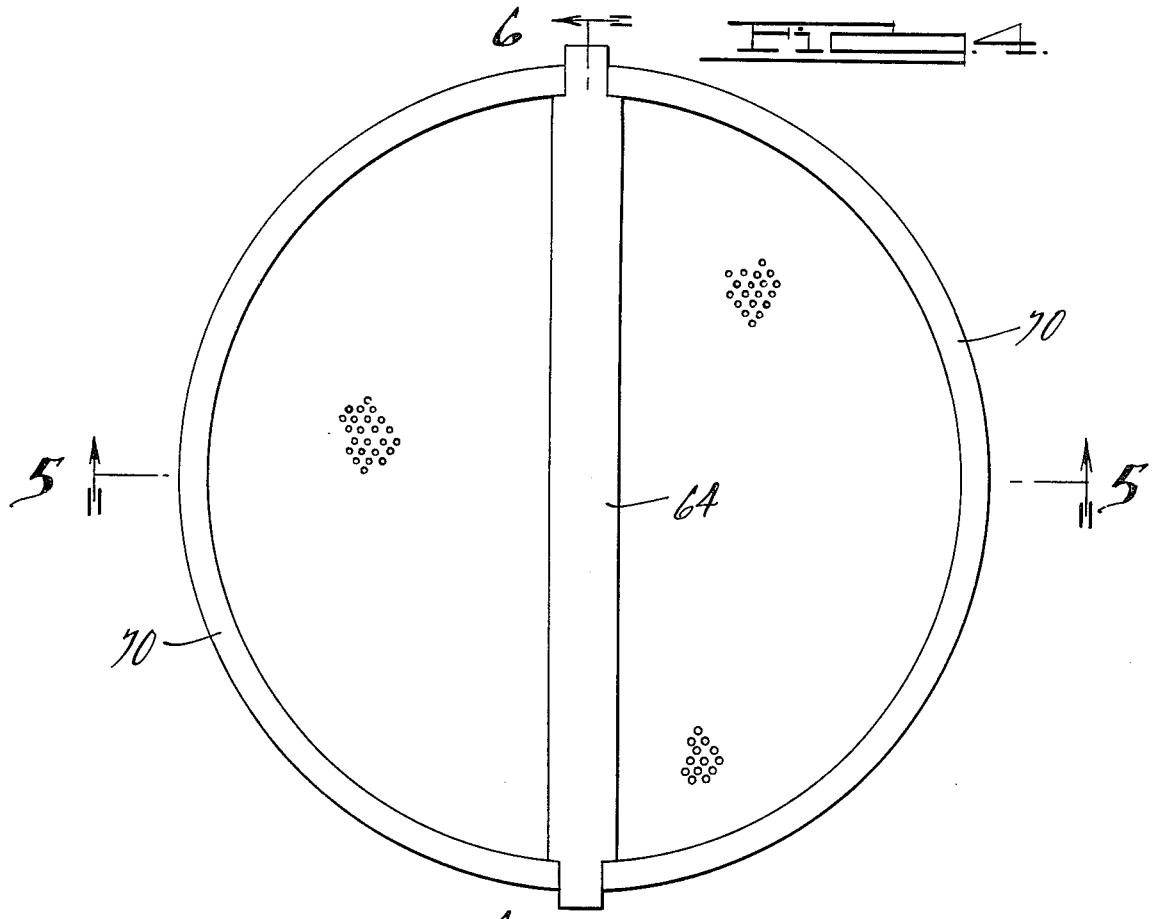
FIG. 4.
FIG. 5.
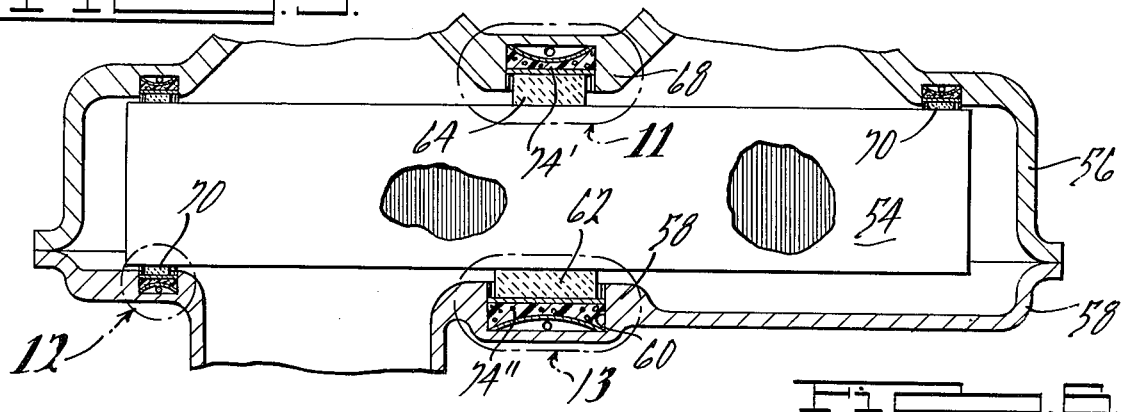
FIG. 6.
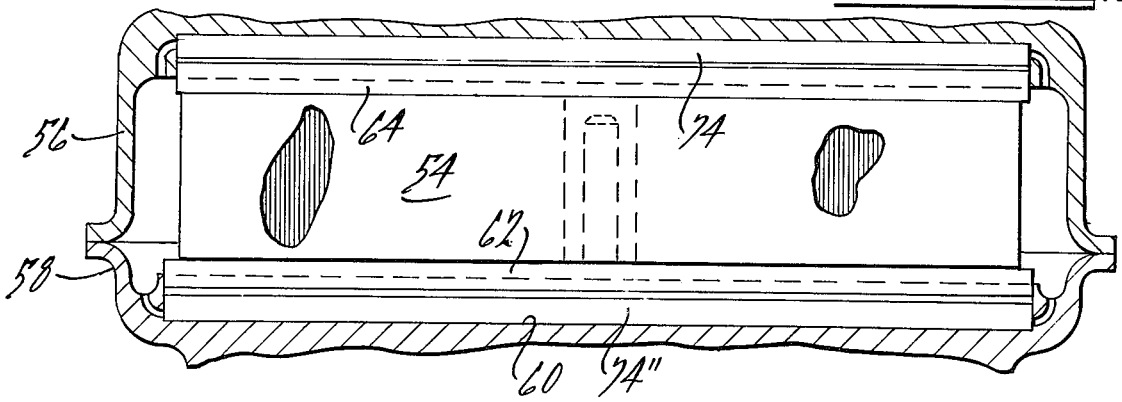

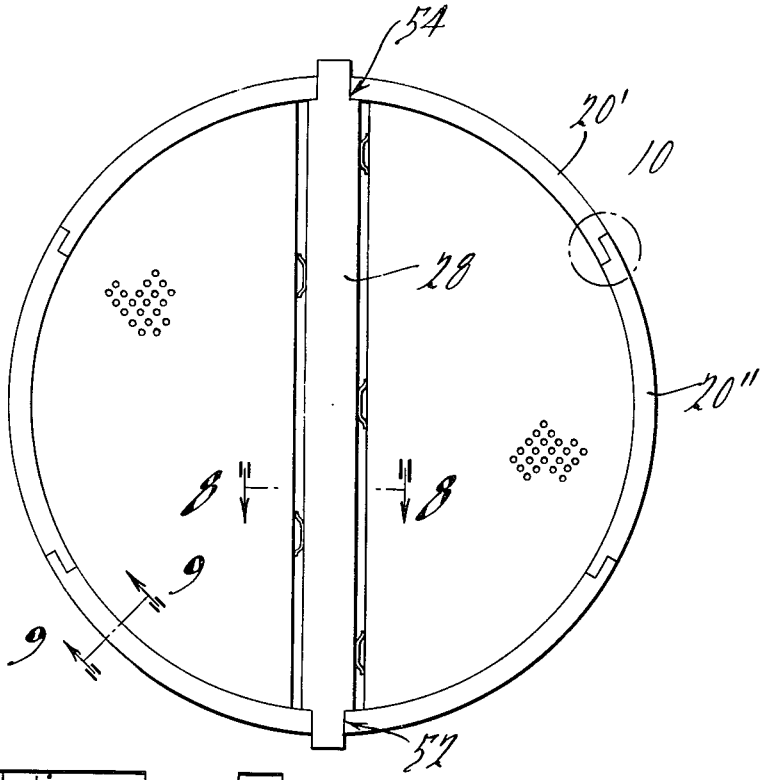
FIG. 7.
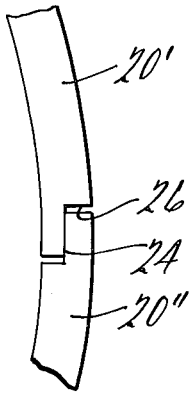
FIG. 10.
FIG. 8.
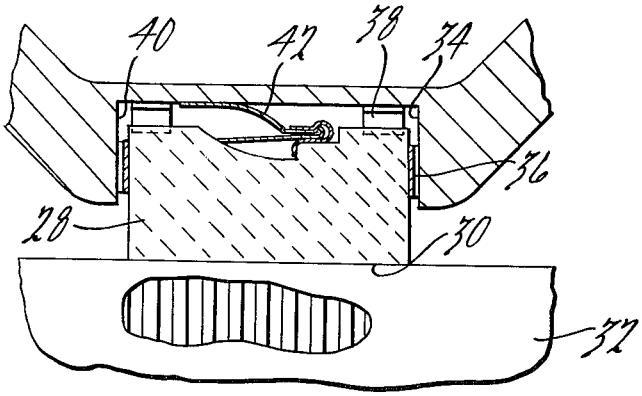
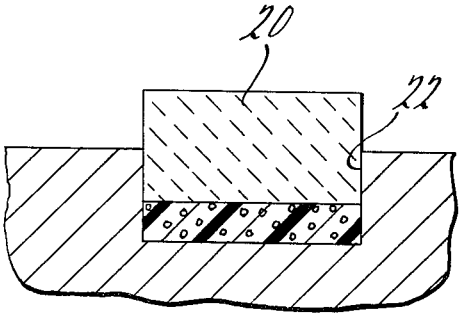
FIG. 9.
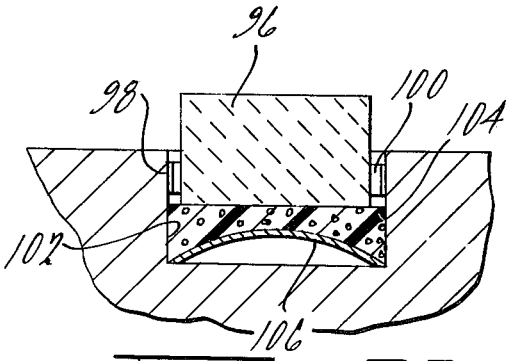
FIG. 9A.

GAS TURBINE GENERATOR SEAL SYSTEM

GENERAL DESCRIPTION OF THE INVENTION

This invention is an improvement in gas turbine regenerator seals of the type disclosed in my U.S. Pat. No. 3,601,414 and in U.S. Pat. No. 3,559,725, both of which are owned by the assignee of this inventon. It is an improvement also over gas turbine and generator seals of the type shown in U.S. Pat. Nos. 3,234,999 and 3,273,904.

My improved seal assembly is adapted to be used with a circular rotary regenerator for use in a gas turbine engine environment. It comprises an inner seal assembly and an outer seal assembly, the assemblies being situated on opposed sides of a cylindrical regenerator core that is adapted to rotate about its geometric axis. Like the seal assembly shown in each of the patents identified here, my present invention comprises an inner seal assembly having two generally semicircular peripheral portions and a crossarm portion which extends diametrically across the adjacent face of the rotary regenerator core. These seal portions define two gas flow passages, one of which accommodates the flow of compressed intake air delivered from the centrifugal compressor of the gas turbine engine and the other of which accommodates flow of high temperature exhaust gases delivered from the power turbine. The seal assembly on the inner side of the regenerator core effectively isolates the low pressure, relatively cool gas flow path from the relatively high temperature exhaust gases. A so-called D seal assembly, which corresponds in configuration generally to one half of the seal assembly on the inner surface of the regenerator core, is located on the opposite regenerator core surface. This includes a so-called crossarm portion extending diametrically across the outer surface of the regenerator core and a semicircular portion which cooperates with the crossarm portion to define a low pressure inlet air flow passage communicating with the gas turbine combustion chamber on its intake side. As the generator core rotates about its axis, the heated exhaust gases raise the temperature of the core in the region of the exhaust flow path. The stored energy in the regenerator core then is passed into the region of the high pressure intake air, thereby causing the intake air to be heated prior to entry into the combustion chamber. My improved seal assembly differs from the prior art constructions, however, by the provision of a monolithic seal portion that sealingly engages the moving surfaces of the regenerator core and the integral retainer for the monolithic seal portions which form a part of the engine bulkhead or a part of the regenerator cover assembly. Provision is made for eliminating undesirable bypassing of gases from one pressure zone to another across the seals by introducing an inert fibrous material in the seal cavity below the monolithic seal element. The seal element itself may be segmented so that if breakage does occur, the damaged portion may be removed and replaced without the necessity for removing the entire seal assembly.

In one embodiment of the invention the seal assembly is adapted to float in the seal cavities and in another embodiment the monolithic seal element is restrained from shifting movement.

The seal cavities may be formed as part of the gas turbine engine bulkhead casting or as part of the regenerator cover assembly. No special machining is required to form the seal cavities, which simplifies the manufacturing techniques and reduces cost substantially. No high tolerance machining is necessitated. The entire seal assemblies need not be replaced when seal failure occurs. This reduces maintenance cost and facilitates assembly because of the lack of a need for delicate handling of precision seal elements. Assembly of replacement parts also is simplified. Furthermore, mass production manufacturing techniques may be employed in the present design whereas such techniques would not be available with prior art designs.

BRIEF DESCRIPTION OF THE FIGURES OF THE DRAWINGS

FIGS. 1, 2 and 3 show an integral peripheral seal with a floating crossarm and a standard or conventional outer seal system.

FIG. 4 is an assembly view similar to FIG. 1 but which shows a semifloating inner seal assembly embodying the features of my invention.

FIG. 5 is a cross sectional view taken along the plane of section line 5—5 of FIG. 4.

FIG. 6 is a cross sectional view taken along the plane of section line 6—6 of FIG. 4.

The embodiment shown in FIGS. 4, 5 and 6 include the features of my invention adapted to both the inner seal assembly and the outer seal assembly.

Figure 1:
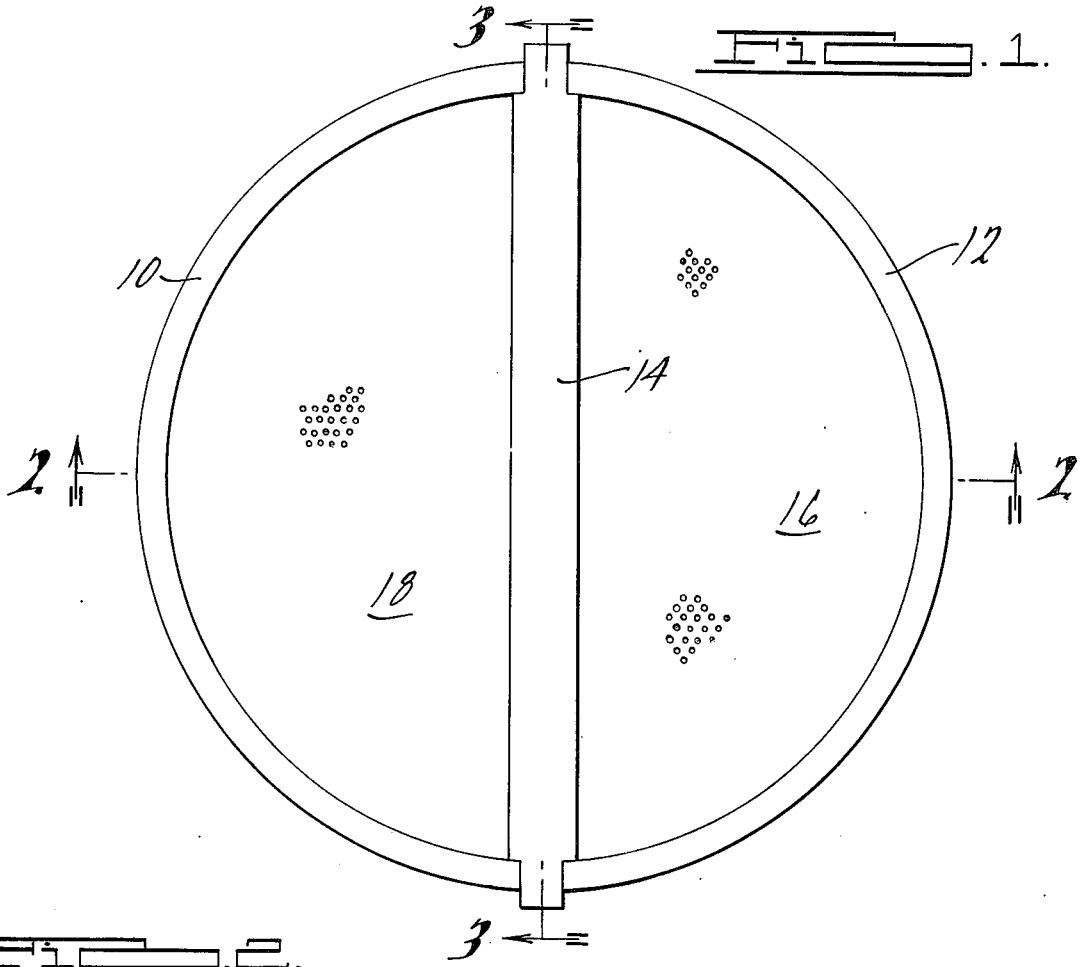
FIG. 1 shows an assembly view of an inner seal assembly embodying the features of my invention.

FIG. 7 shows another embodiment of my invention in which portions of the seal assembly embody the integral seal concept of FIG. 1 and the crossarm seal assembly embodies the semifloating seal concept of FIGS. 4, 5 and 6.

FIG. 8 is a cross sectional view of a crossarm seal assembly as seen from the plane of section line 8—8 of FIG. 7.

FIG. 9 is a cross sectional view of the peripheral seal portion of the assembly of FIG. 7 as seen from the plane of section line 9—9 of FIG. 7.

FIG. 9A is a view similar to FIG. 9 although it shows a peripheral seal element of the semifloating type rather than the integral type of FIG. 9.

FIG. 10 is a detailed view of an expanded joint where two seal segments are joined to form continuous portions of the peripheral seal element for the embodiment of FIG. 7 as well as the embodiment of FIGS. 1 and 4.

Figure 11:
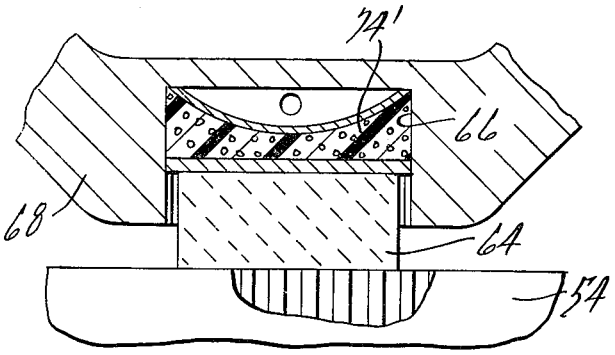

FIG. 11 is a partial cross sectional view showing an inner crossarm seal assembly located in a bulkhead recess. This is an enlarged view of the corresponding seal assembly pictured in FIG. 5.

Figure 12:
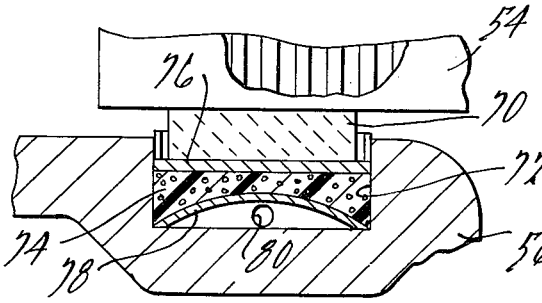

FIG. 12 is an enlarged view of the inner peripheral seal element which is seen in the assembly view of FIG. 5.

Figure 13:
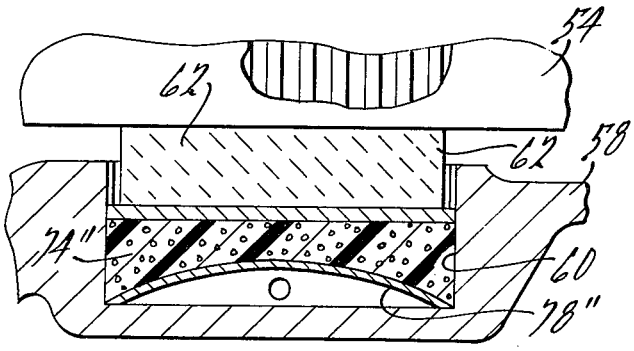

FIG. 13 is an enlarged view of the outer crossarm seal assembly which is shown in the assembly view of FIG. 5.

Figure 14:
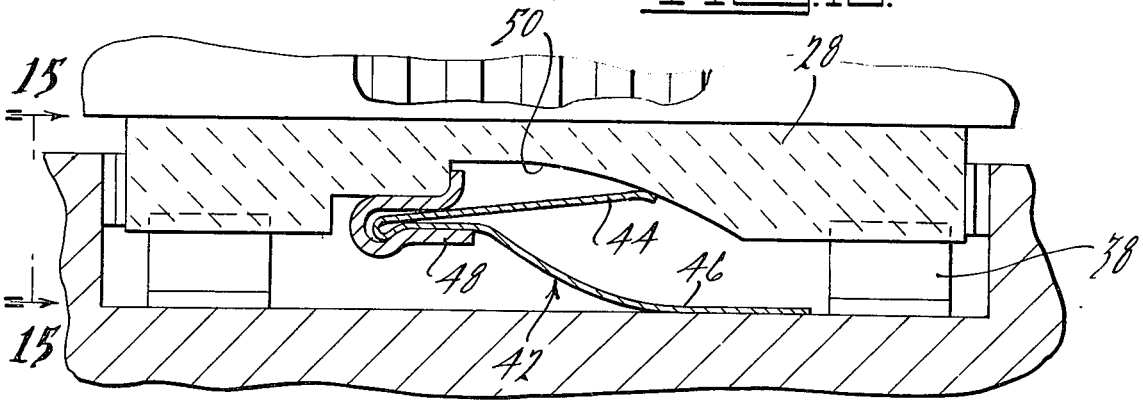

FIG. 14 shows a crossarm seal assembly with the controlling springs which restrain and limit shifting movement of the seal assembly in its seal cavity.

Figure 15:
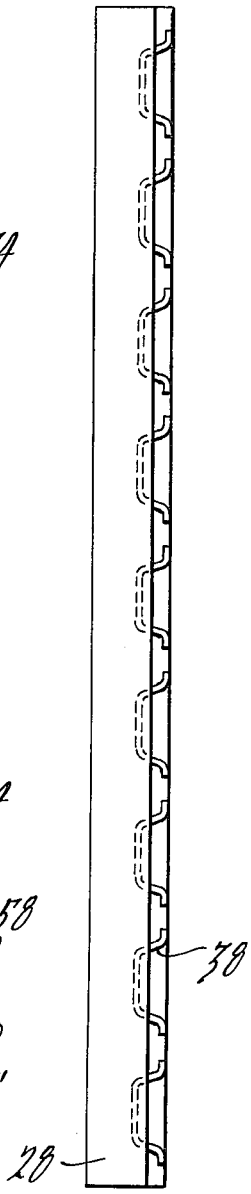

FIG. 15 is a side view of the assembly of FIG. 14 showing the crossarm seal assembly with stabilizer springs situated to provide equalized load distribution on the cross arm seal element.

Figure 16:
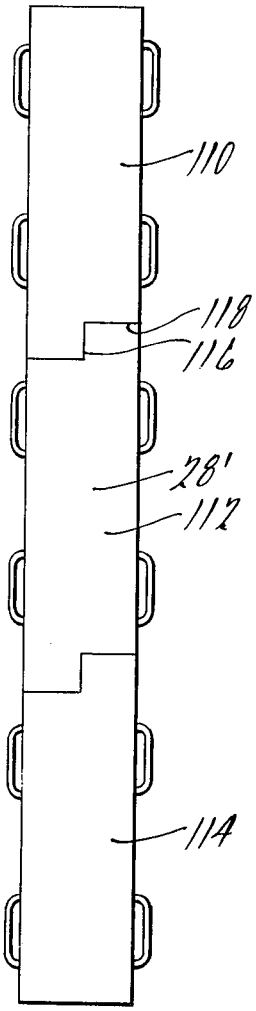

FIG. 16 is a view of a segmented seal construction.

PARTICULAR DESCRIPTION OF THE INVENTION

FIG. 1 shows a first peripheral seal element 10 and a second peripheral seal element 12. These are assembled in generally end-to-end relationship to form a cylindrical configuration. A crossarm seal assembly 14 extends diametrically across the generally circular configuration of the peripheral seals.

A high pressure region 16 is defined by a peripheral seal element 12 and the crossarm seal element 14. This region is exposed to the discharged side of the gas turbine compressor and seals the high pressure gas from the low pressure region 18. This region is in communication with the hot exhaust flow gases passing from the outlet side of the power turbine wheel.

Figure 2:
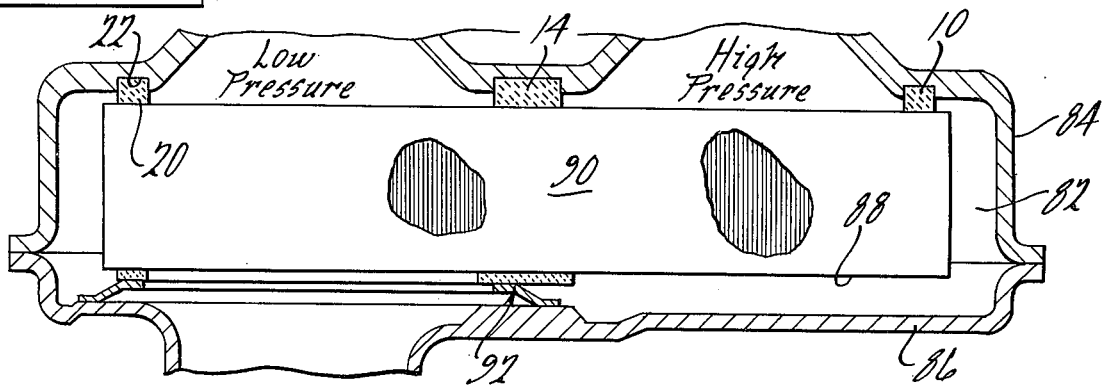
FIG. 2 is a cross sectional view taken along the plane of section line 2—2 of FIG. 1.
Figure 3:
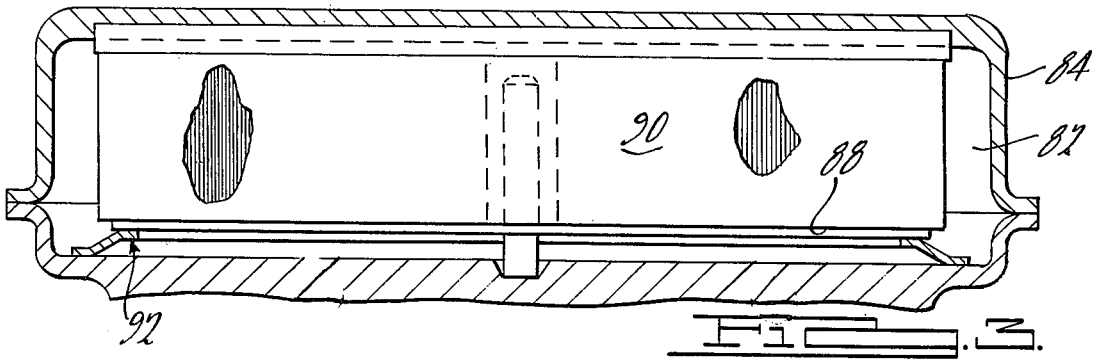
FIG. 3 is a cross sectional view taken along the plane of section line 3—3 of FIG. 1.

My improved seal construction does not include the usual diaphragm seal elements such as seal assemblies of the type described in U.S. Pat. Nos. 3,273,904 and 3,234,999. Instead my seal assembly comprises a monolithic seal element for both the peripheral seal portion of the assembly and the crossarm portion. As seen in FIGS. 2 and 9, the peripheral seal element is identified by reference character 20. It is located in a cavity 22 of generally rectangular cross section. This cavity is formed in the bulkhead of the engine during the casting operation and it need not be finish machined. The cavity does not require extremely close tolerances and the casting can be fabricated with only a minimum amount of finish machining. The seal segments for the peripheral seal may be inserted into the C-shaped portion of the cavity by means of the so-called press fit technique. That is, the seal segments themselves may be machined so that they are slightly wider, perhaps by 0.002 inches, than the cooperating cavity. The segments then are cooled in dry ice to below −50° and inserted into the cavity. The material of which the peripheral seal segments are formed has a slightly higher coefficient of thermal expansion than the housing material, which in the preferred embodiment of my invention would be nodular iron. Thus, a tight fit is maintained during operation of the engine at high temperatures. I have successfully used a seal material that comprises 70 percent copper, 15 percent sodium fluoride (NaF) and 15 percent lithium fluoride (LiF).

As best seen in FIG. 9, the cavity below the seal element itself is filled with an inert fibrous material, such as Fiberfrax or asbestos. This prevents leakage around the seal in the event that a clearance exists between the seal element and the walls of the surrounding cavity.

I have shown in FIG. 10 a typical expansion joint between two segments of the peripheral seal. One seal element is shown at 20′ and a companion seal element is shown at 20″. The ends of the segments 20′ and 20″ are arranged in abutting relationship, and each is formed with a flat surface 24 which sealingly engages a surface on the companion seal segment. Each seal has a second surface 26 formed in generally perpendicular disposition with respect to its surface 24. As one segment expands with respect to the other, the sealing is maintained with minimum leakage at the expansion joint.

I have shown in FIG. 8 a typical cross section for the seal assembly for the crossarm. In this particular embodiment, I have used a semifloating crossarm seal assembly which includes a ceramic block which serves as a monolithic seal element. This is identified by reference character 28. The sliding seal surface for the block 28 is shown at 30. It engages a companion side surface of a ceramic regenerator core 32. Core 32 has airflow passages to permit the passage of hot exhaust gases in one direction and relatively cool, high pressure inlet air in the opposite direction. The high airflow and the cool airflow each occurs in separate zones as explained previously. As in the case of the peripheral seal element, the crossarm seal element 28 is received in the seal cavity 34 formed in the inner bulkhead during the casting of the bulkhead. The cavity is formed so that a clearance exists in the sides of the seal element 28 and the cavity walls. Locating springs 36 are situated on either side of seal element 28 so that the seal element 28 may be properly located within its cavity although the springs will accommodate a slight shifting movement thereby providing a semifloating characteristic for the seal element. Springs 36 are leaf-type springs which protect the crossarm assembly from breakage in case of severe bulkhead distortion or in case of shock loads.

Stabilizer leaf springs 38 are located between the base of the cavity 40 for the seal element 28 and the adjacent surface of the seal element 28. These springs act as stabilizers that provide equalized load distribution. They also prevent breakage of the crossarm due to distortion of the bulkhead or due to occasional impact loading in the heat exchanger. These springs can be fabricated from high temperature alloys.

The seal construction and the springs are shown in better detail in FIG. 14. Also shown in FIG. 14 is a diaphragm-type seal 42 which includes two leaf-type diaphragms 44 and 46 joined together at one margin by retainer means 48. In FIG. 8, the high pressure side of the seal system is the left-hand side. The seal 42 then becomes pressure loaded into sealing engagement with the base of the cavity and with inner sealing surface 50 formed on the base of the seal element 28. This prevents cross flow of gases from the left-hand high pressure side to the right-hand low pressure side as seen in FIG. 8.

The joints between each end of the crossarm seal element and the adjacent ends of the peripheral seal element are indicated generally by reference characters 52 and 53 in FIG. 7. These can be sealed by using a suitable fibrous inert material located in the crossarm seal element recess and in the communicating portions of the peripheral seal element recesses.

In FIGS. 11, 12 and 13 I have shown in detail the construction of the semifloating inner and outer seal systems of FIG. 5. The semifloating seal concept is used on the peripheral seal elements as well as the crossarm seal elements and both the inner and outer sides of the regenerator core, the latter being identified by reference character 54. The bulkhead for the engine is shown at 56 and the so-called regenerator cover assembly is shown at 58. The cover assembly has a crossarm seal element recess 60 which receives the monolithic seal element 62. The crossarm seal element for the inner seal assembly includes a monolithic seal element 64 received in the cavity 66 formed in the bulkhead portion 68 of the engine casting. The peripheral seal element for the high pressure side of the regenerator is shown in FIGS. 5 and 12 at 70. It is received in the seal cavity 72 formed in bulkhead 56.

Located in each recess 72, 66 and 60 is a silicone sponge rubber material 74. Located between the material 74 and the seal element 70 is a thermal fiber insulation layer 76. A high temperature alloy spring, which is curvilinear in cross section, is located in the base of cavity 72 to provide a seat for the sponge material. Each spring is identified by reference character 78. The seal constructions shown in FIGS. 11 and 13 are similar to that described with reference to FIG. 12 and similar reference characters are used to identify the corresponding elements although prime and double prime notations are added. A bleed hole 80 is situated below the spring 78 within the cavity 72 for the purpose of allowing introduction of high pressure cooling air to the seal. This cooling air is bleed-off from the high pressure seal side of the regenerator through suitable internal passages formed in the engine bulkheads or in the cover assembly.

It is apparent from an examination of FIG. 2, that high pressure gases will surround the regenerators and occupy the space 82 defined by the engine housing of bulkhead 84 and by the regenerator cover 86. The outer sealing surface 88 of the regenerator core 90 shown in FIG. 2 is sealed by a conventional seal assembly indicated generally by reference character 92.

Shown in FIG. 9A is a semifloating peripheral seal element 96. It embodies features of the semifloating seal assembly described previously, but it is applied to the peripheral seal element rather than the crossarm seal element. It includes side loaded leaf springs 98 and 100 which are situated between the peripheral seal element 96 and the adjacent walls of the seal cavity 102. The cavity 102 is generally rectangular in form and is generally similar in shape to the shape of the seal element 96. The base of the cavity 102 receives a silicone sponge material 104, and metallic spring 106 contains sponge material 104 and provides an upward force on the element 96. The same is true for the spring 78 in the case of the FIG. 12 construction. The loading on the peripheral seals is controlled by controlling the rate of the springs 106. The loading of the crossarm seal elements is controlled by providing the proper spring rates for springs 78'' in the FIG. 13 construction.

In addition to the spring loading, gas pressure loading of the outer seal assembly 92 is present in the FIG. 2 construction. The outer seal leaf springs or diaphragm seal elements can be stiffened if further sealing effort is desired to complement the air pressure forces acting on the heat exchanger. These forces tend to move the heat exchanger core inwardly against the sealing surface of the inner seal assembly. These forces also balance the forces produced by the high pressure gases on the inner seal assembly. The latter gas forces can be controlled by providing high pressure bleed passages in the bulkhead casting.

I have shown in FIG. 16 a segmented seal element for a crossarm seal assembly which is identified by reference character 28'. This would correspond to the crossarm seal element 28 as shown in the FIG. 7 embodiment. The seal element 28' includes expansion joints which are designed to provide gas-tight surface-to-surface sealing preventing leakage. The sealing is accomplished by forming the abutting ends of the individual seal segments 110, 112 and 114 with sliding seal surfaces 116. Each segment has a second seal surface 118 situated in generally perpendicular disposition with respect to the sealing surface 116. As in the case of the peripheral seal element, one damaged segment may be removed and replaced with a fresh segment without the necessity for removing the other segments of the assembly.

Having described preferred embodiments of my invention, what I claim and desire to secure by U.S. Letters Patent is:

1. A monolithic rubbing seal assembly for sealing a rotary regenerator in a gas turbine engine environment, said seal assembly having at least one generally semicircular, monolithic seal element, a crossarm seal element joining the ends of said semicircular seal element thereby defining a gas flow region, a housing base for said seal assembly with a general semicircular cavity and a cavity conforming generally in shape to the shape of said crossarm seal element, said cavities receiving said seal elements whereby said seal elements, together with said base, define an integral assembly, said seal elements being formed of ceramic material and each having a surface adapted to sealingy engage the adjacent surface of said regenerator, clearance between the transverse sides of said seal and the adjacent wall of said cavities and a heat resistant resilient material located between the seal elements and the base of the respective seal cavities, said resilient material engaging the transverse sides of said cavities and defining with said cavities a cooling air flow chamber in communication with a high pressure, low temperature gas region for accommodating air flow in the direction of the principal axis of said seal whereby said resilient material is cooled as said seal elements are urged pneumatically into sealing engagement with respect to said regenerator core.

2. The combination set forth in claim 1 wherein at least one seal element is formed in segments, each segment being arranged in end-to-end relationship with respect to a companion segment, the registering ends of the segments having formed thereon sealing surfaces that slidably register to define a gas-tight expansion joint whereby the individual segments of said seal element may be assembled and replaced independently of the adjacent seal segments.

3. The combination set forth in claim 1 wherein said seal assembly comprises two generally semicircular seal elements situated in end-to-end relationship thereby defining a generally circular seal configuration, said crossarm seal element being generally diametrically disposed with respect to said semicircular seal elements, said semicircular seal elements and said crossarm seal element defining separate gas flow zones, one zone being of high pressure and the other zone being of low pressure, said resilient material energizing the aforesaid transverse sides of said cavities in sealing relationship whereby said resilient material defines with said cavities the aforesaid cooling air flow chamber.

4. The combination set forth in claim 2 wherein said seal assembly comprises two semicircular peripheral seal elements situated in end-to-end relationship thereby defining a generally circular seal configuration, said crossarm seal element being generally diametrically disposed in respect to said surface seal elements, said peripheral seal elements and said crossarm seal element defining separate gas flow zones, one zone being of high pressure and the other zone being of low pressure.

5. The combination as set forth in Claim 1 wherein said seal cavities are slightly larger in cross sectional dimensions than the corresponding dimensions of the registering seal elements, and spring means situated between the sides of said seal elements and adjacent walls of the registering cavity whereby the seal elements are cushioned while protecting them from breakage due to thermal distortion and shock loads.

6. The combination set forth in claim 2 wherein said seal cavities are slightly larger in cross sectional dimensions than the corresponding dimensions of the registering seal element, and spring means situated between the sides of said seal elements and adjacent walls of the registering cavity whereby the seal elements are cushioned while protecting them from breakage due to thermal distortion and shock loads.

* * * * *